US008998355B2

(12) United States Patent
Hunter et al.

(10) Patent No.: US 8,998,355 B2
(45) Date of Patent: Apr. 7, 2015

(54) DRAWER GUIDE SYSTEM

(71) Applicant: Handy Button Machine Co., Wheeling, IL (US)

(72) Inventors: Thomas Hunter, Williams Bay, WI (US); Robert A. Moris, New Lenox, IL (US); Raymond Davidson, Westchester, IL (US)

(73) Assignee: Handy Button Machine Co., Wheeling, IL (US)

( * ) Notice: Subject to any disclaimer, the term of this patent is extended or adjusted under 35 U.S.C. 154(b) by 0 days.

(21) Appl. No.: 14/211,893

(22) Filed: Mar. 14, 2014

(65) Prior Publication Data

US 2014/0265791 A1 Sep. 18, 2014

Related U.S. Application Data

(60) Provisional application No. 61/792,845, filed on Mar. 15, 2013.

(51) Int. Cl.
*A47B 88/00* (2006.01)
*A47B 88/16* (2006.01)

(52) U.S. Cl.
CPC ..... *A47B 88/16* (2013.01); *A47B 88/00* (2013.01)

(58) Field of Classification Search
CPC ..... A47B 88/00; A47B 88/10; A47B 88/16
USPC ..... 312/333, 334.1, 334.24–334.34, 312/334.36–334.44, 334.46, 334.47
See application file for complete search history.

(56) References Cited

U.S. PATENT DOCUMENTS

| | | | | |
|---|---|---|---|---|
| 1,412,699 | A | | 4/1922 | Manchester |
| 2,277,703 | A | | 3/1942 | Kennedy et al. |
| 2,698,214 | A | * | 12/1954 | Skamser ..... 312/334.5 |
| 2,857,233 | A | * | 10/1958 | Hahn et al. ..... 312/334.31 |
| 3,363,960 | A | | 1/1968 | Reiss et al. |
| 3,702,717 | A | * | 11/1972 | Gutner ..... 384/23 |
| 4,067,632 | A | | 1/1978 | Sekerich |
| D270,413 | S | | 9/1983 | Gutner et al. |
| 4,501,453 | A | * | 2/1985 | Gutner et al. ..... 384/23 |
| 4,679,950 | A | * | 7/1987 | Delmege et al. ..... 384/18 |
| 4,872,734 | A | | 10/1989 | Rechberg |
| 5,147,138 | A | | 9/1992 | Gutner et al. |
| 5,275,483 | A | * | 1/1994 | Rasmussen ..... 312/334.41 |

(Continued)

FOREIGN PATENT DOCUMENTS

WO WO-2013/010139 1/2013

*Primary Examiner* — Daniel Rohrhoff
(74) *Attorney, Agent, or Firm* — Marshall, Gerstein & Borun LLP

(57) ABSTRACT

A drawer guide system having a case runner plastic assembly and a drawer guide plastic assembly for receiving the case runner plastic assembly. The case runner plastic assembly includes a case runner plastic adapted to be secured to a drawer frame, and a case runner attached to the case runner plastic and having a pair of cam mechanisms. The drawer guide plastic assembly includes a drawer guide adapted to be secured to a drawer, and a drawer guide plastic secured to the drawer guide. The drawer guide plastic includes a pair of tabs, and the drawer guide includes a pair of side walls, each of which has a window for receiving the pair of tabs. Upon contact with the tabs of the drawer guide plastic, the cam mechanisms automatically rotate into the corresponding windows, temporarily securing the case runner plastic to the drawer guide.

21 Claims, 14 Drawing Sheets

(56) References Cited

U.S. PATENT DOCUMENTS 6,116,706 A * 9/2000 Pomerleau et al. ..... 312/334.31
6,485,120 B1 * 11/2002 Pomerleau et al. ..... 312/334.27
7,296,863 B2 11/2007 Lam et al.
7,866,772 B1 * 1/2011 Chen ..... 312/334.9
2008/0036345 A1 * 2/2008 Kropf et al. ..... 312/333
2012/0319548 A1 * 12/2012 Netzer ..... 312/334.1

* cited by examiner

DRAWER GUIDE SYSTEM

REFERENCE TO RELATED APPLICATION

This application claims the benefit of the filing date of U.S. Provisional Application No. 61/792,845 filed Mar. 15, 2013. The entire disclosure of U.S. Provisional Application No. 61/792,845 is incorporated herein by reference.

FIELD OF THE DISCLOSURE

This disclosure relates generally to drawer assemblies, and, more particularly, to a case runner drawer guide assembly with interlocking capability.

BACKGROUND OF THE DISCLOSURE

Many furniture manufacturers use metal drawer guide assemblies having an elongate stationary lower metal case runner. The metal case runner is secured to an inside structure of a furniture article, and an elongate upper metal drawer guide is secured to the bottom of a drawer at front and rear ends of the drawer, for example. See, e.g., U.S. Pat. No. 6,116,706. Plastic drawer glides are then often mounted to somewhere in the vicinity of a rear wall of a drawer to facilitate movement of the drawer along the lower metal case runner. In most conventional drawer guide assemblies, the lower metal case runner consists of a generally U-shaped (or T-shaped) metal rail (in cross-section), having flanges projecting horizontally outwardly from the upper ends thereof. The upper metal drawer guide is generally C-shaped in cross-section and may have an integral, upwardly-extending metal tab member at the rear end that is secured to the wall of the drawer. Plastic drawer glides prevent complete metal-to-metal contact between the case runner and the drawer guide and assist with the movement of the drawer along the case runner.

It is desired to reduce friction between relatively-movable components of a drawer guide assembly so as to improve relative movement between the drawer guide and the case runner. It is further desirable to provide a drawer guide system that enables a drawer to be virtually fully extended from a fully closed position within a cabinet or drawer frame, without having any further extension or dislodgement of the drawer and/or imbalance of the cabinet.

SUMMARY OF THE DISCLOSURE

The present disclosure is directed to a drawer guide system for a drawer of a drawer frame of a cabinet or other similar furniture piece. Generally, the drawer guide system includes a case runner plastic assembly having a case runner plastic adapted to be secured to the drawer frame at one end and a case runner at the other end. The case runner plastic includes a pair of cam mechanisms, as described in more detail below.

The drawer guide system further includes a drawer guide plastic assembly having a drawer guide adapted to be secured to the drawer and a drawer guide plastic inserted into and secured to the drawer guide. The drawer guide includes a pair of side walls, each of which includes a window, and runs along a longitudinal axis of the case runner during operation of the drawer. More specifically, the case runner of the case runner plastic assembly fits within the drawer guide of the drawer guide plastic assembly to connect the case runner plastic assembly to the drawer guide plastic assembly, forming the drawer guide system.

During operation of the drawer, e.g., when the drawer and, thus, drawer guide are extended from a closed position to an open position, the cam mechanisms of the case runner plastic automatically rotate about an axis perpendicular to the longitudinal axis of the case runner upon contacting a tab within each window of the drawer guide. The cam mechanisms of the case runner plastic rotate into the windows of the drawer guide, locking the drawer guide plastic assembly and preventing any further extension of the drawer guide and imbalance of the cabinet, thereby avoiding unwanted dislodgement of the drawer. In addition, rolling surfaces of both the drawer guide plastic and the case runner plastic reduce friction between the case runner and drawer guide, improving movement between the same, as also explained in more detail below.

Detailed Description of The Disclosure

Figure 1:
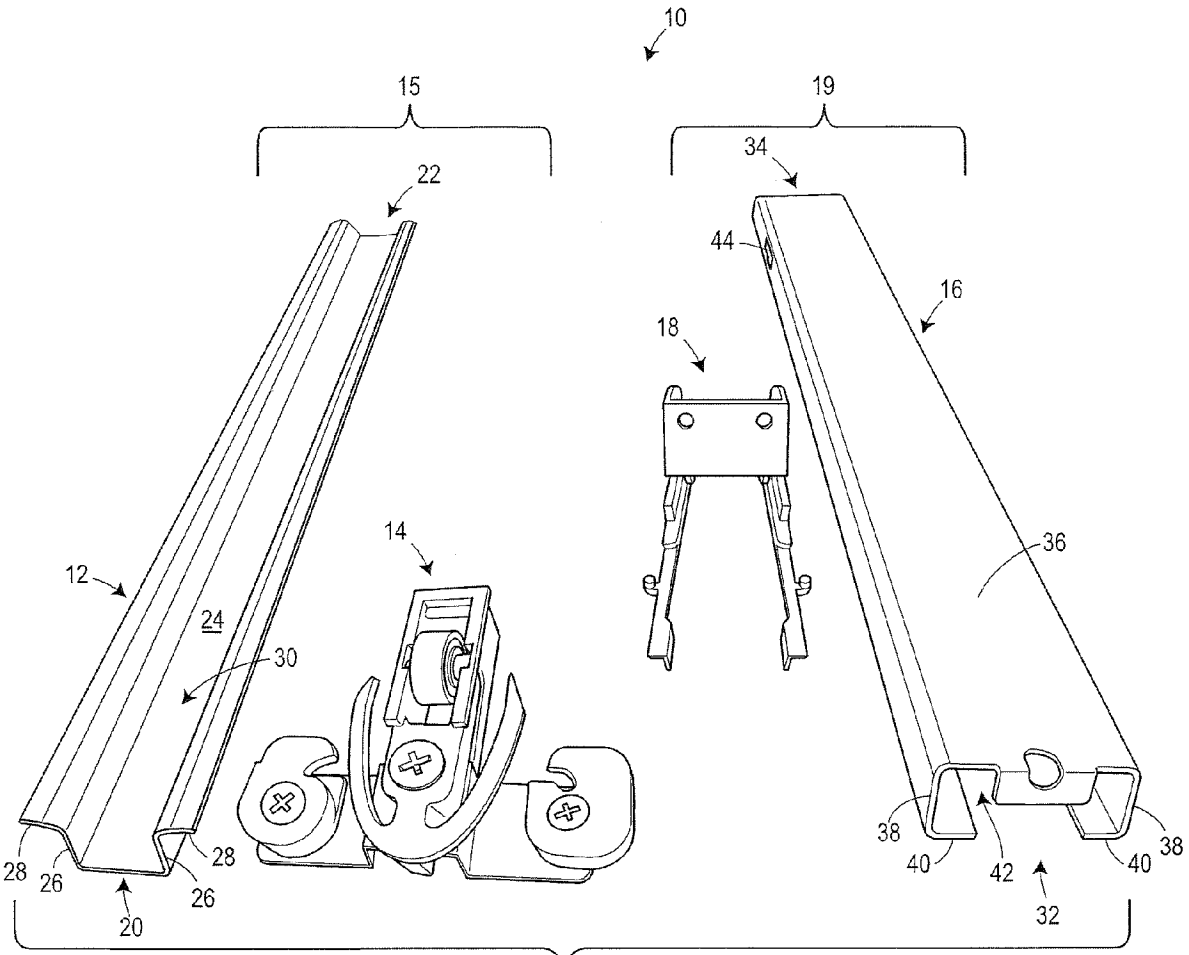
FIG. 1 is a perspective view of a case runner, a case runner plastic, a drawer guide and a drawer guide plastic of a drawer guide system of the present disclosure.
Figure 7:
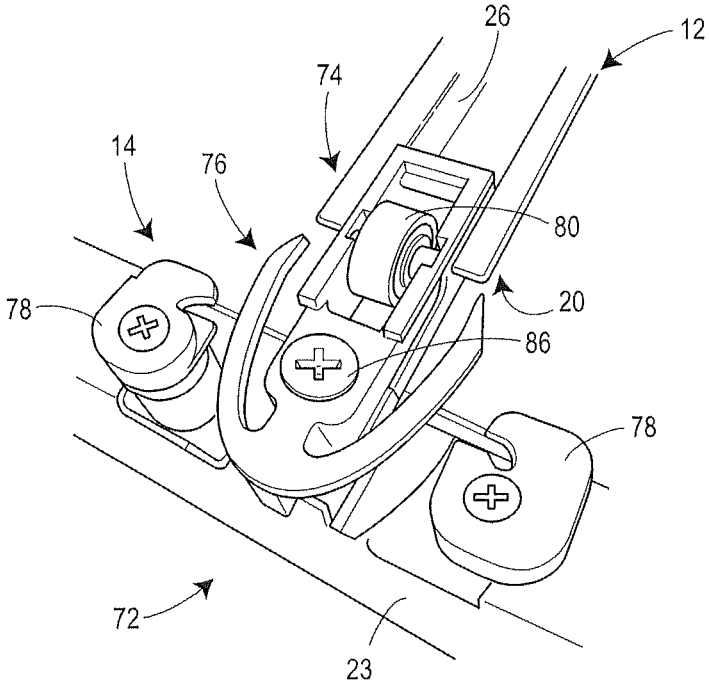
FIG. 7 is a top perspective view of the case runner of FIG.1 attached to the case runner plastic of FIG. 1.

Referring now to FIG. 1, a perspective view of the drawer guide system 10 of the present disclosure is illustrated. The drawer guide system 10 includes a case runner 12, a case runner plastic 14, a drawer guide 16, and a drawer guide plastic 18. A first end of the case runner plastic is secured to the drawer frame (FIGS. 7 and 8) and a second end is disposed within and secured to the case runner 12, forming a case runner plastic assembly 15. The drawer guide plastic 18 is inserted into the drawer guide 16, forming a drawer guide plastic assembly 19. The drawer guide plastic assembly 19 receives the case runner 12 of the case runner plastic assembly 15, improving relative movement between the drawer guide 16 and the case runner 12, for example, as explained in more detail below.

The case runner 12 includes a rail having a U-shaped cross-section and a front end 20, a rear end 22 and a base 24. A pair of side walls 26 is attached to the base 24, and a pair of outwardly extending flanges 28 is attached to the pair of side walls. Both the pair of side walls 26 and the pair of outwardly extending flanges 28 extend from the front end 20 to the rear end 22 of the case runner 12. An elongate recess 30 is disposed between the base 24 and the pair of side walls 26.

The drawer guide 16 may be C-shaped in cross-section and includes a front end 32, a rear end 34, a top portion 36, and a pair of side walls 38 attached to and extending from the top portion 36. A pair of inwardly extending flanges 40 is attached to the pair of side walls 38, such that both the pair of side walls 38 and the pair of inwardly extending flanges 40 extend from the front end 32 to the rear end 34 of the drawer guide 16. An elongate recess 42 is disposed between the top portion 36 and the pair of side walls 38, and a window 44 is disposed on each side wall 38 of the pair of side walls at the rear end 34 of the drawer guide 16, as illustrated in FIG. 1. While various materials may be used, the drawer guide 16 is typically made of metal.

Figure 2:
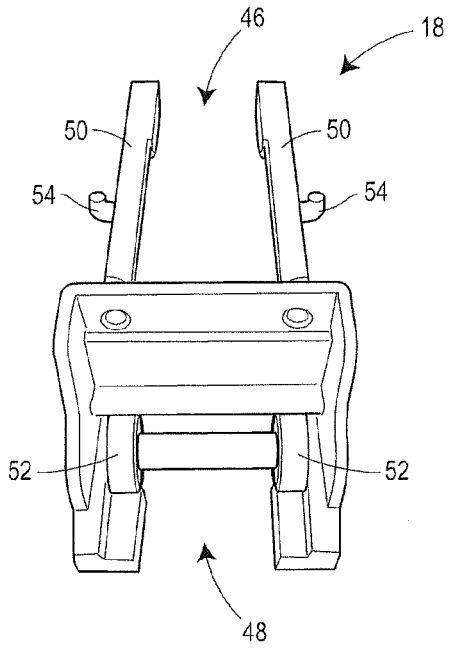
FIG. 2 is a rear perspective view of the drawer guide plastic of FIG. 1.

Referring now to FIG. 2, a rear perspective view of the drawer guide plastic 18 is illustrated. The drawer guide plastic 18 includes a front end 46 and a rear end 48 and is adapted to be disposed in the recess 42 at the rear end 34 of the drawer guide 16, as explained in more detail below. The front end 46 includes a pair of legs 50, and the rear end 48 includes a pair of rollers 52. Each leg of the pair of legs 50 includes a tab 54 that is adapted to be received within the respective complementary window 44 of the drawer guide 16 when the front end 46 of the drawer guide plastic 18 is inserted into the rear end 34 of the drawer guide 16 to secure the drawer guide plastic 18 within the drawer guide 16, as explained below. The legs 50 are also biased in an outward direction, allowing the tabs 54 to readily enter the windows 44 within the side walls 38 of the drawer guide 16 upon insertion of the drawer guide plastic 18 into the rear end 44 of the drawer guide 16. The tabs 54 of the drawer guide plastic 18 extend outside of the windows 44 (FIGS. 5 and 6) of the pair of side walls 38, such that together the tabs 54 and the windows 44 form a stop mechanism when the drawer guide 16 is in a fully extended position. In addition, the pair of rollers 52 contacts the pair of flanges 28 of the case runner 12, reducing friction between the case runner 12 and the drawer guide 16.

Figure 3:
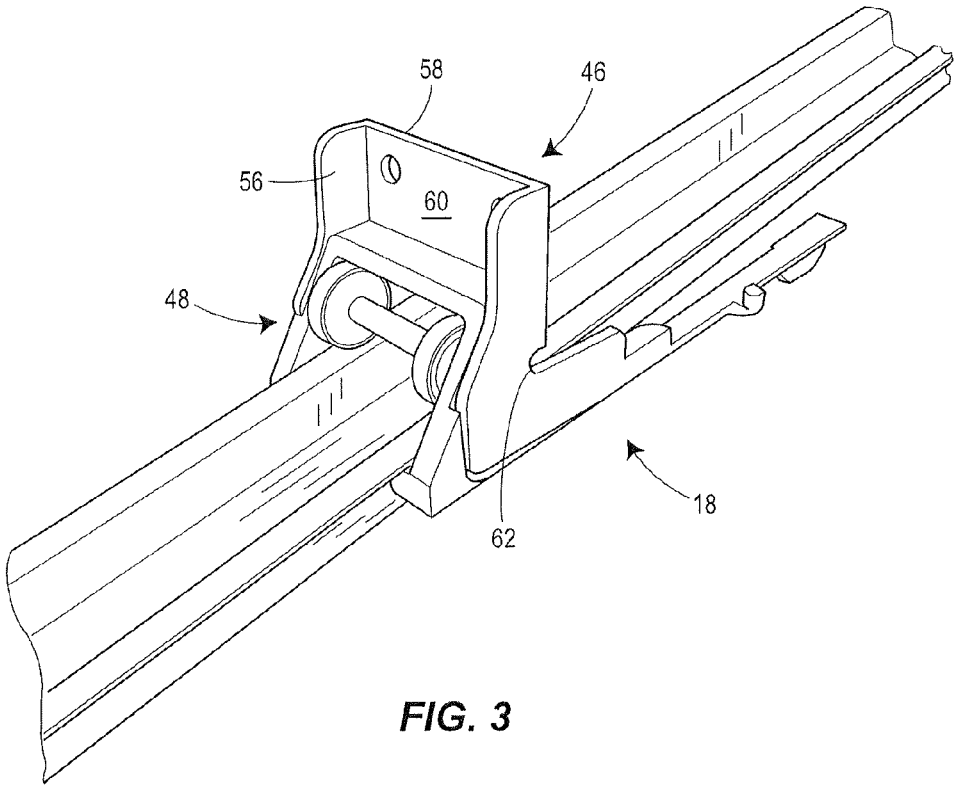
FIG. 3 is another perspective view of the drawer guide plastic of FIG. 1.
Figure 4:
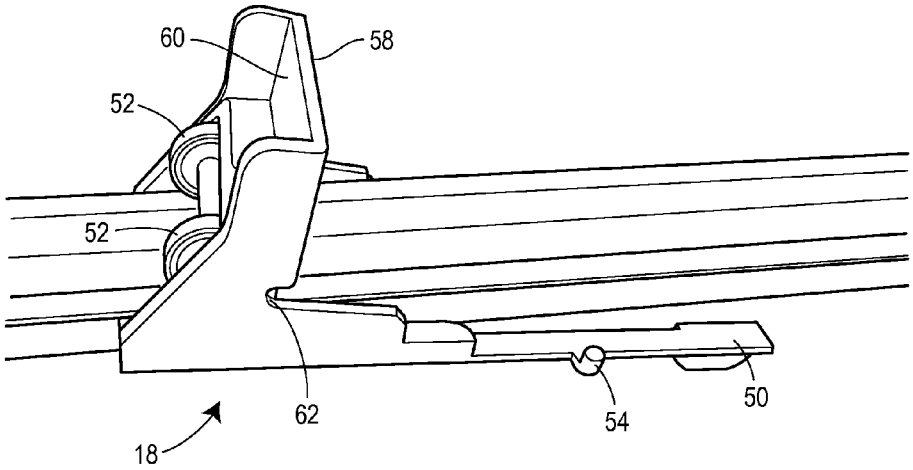
FIG. 4 is a side perspective view of the drawer guide plastic of FIG. 1.

Referring now to FIGS. 3 and 4, the drawer guide plastic 18 further includes an upright portion 56 disposed between the front end 46 and the rear end 48 of the drawer guide plastic 18. The upright portion 56 includes a front face 58, a rear face 60 and a notch 62 disposed on the front face 58. The notch 62 engages an edge of the rear end 34 of the drawer guide 16 (as illustrated in FIG. 6) upon insertion of the legs 50 of the drawer guide plastic 18 into the rear end 34 of the drawer guide 16, forming the drawer guide assembly 19.

Figure 5:
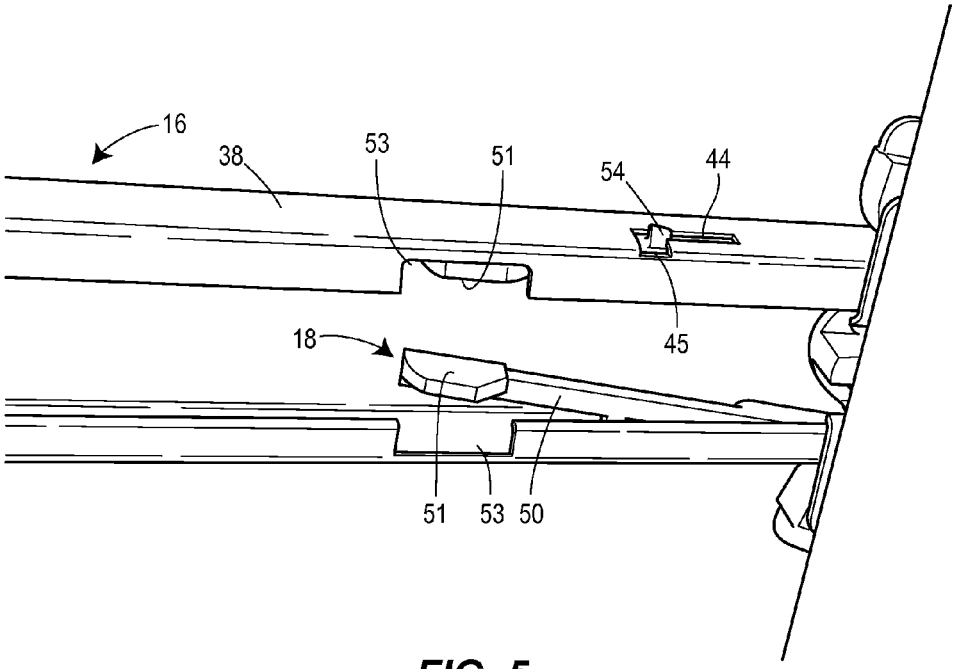
FIG. 5 is a bottom perspective view of the drawer guide plastic of FIG. 1 disposed within the drawer guide.
Figure 6:
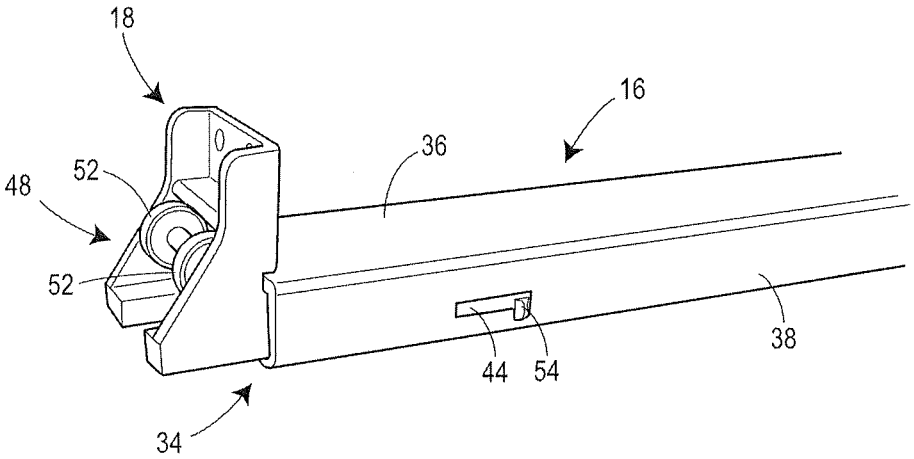
FIG. 6 is a side perspective view of a rear portion of the drawer guide having the drawer guide plastic disposed therein.

Referring now to FIGS. 5 and 6, the front end 46 of the drawer guide plastic 18 is inserted into the rear end 34 of the drawer guide 16. Because the legs 50 of the drawer guide plastic 18 are biased in an outward direction, the tabs 54 on each leg 50 of the pair of legs of the drawer guide plastic 18 readily fit and push into the corresponding windows 44 disposed on the side walls 38 of the drawer guide 16 at the rear end 34 of the drawer guide 16 after insertion. Upon further insertion of the drawer guide plastic 18 into the drawer guide 16, the tabs 54 of the legs 50 find the projections 45 of the windows 44 of the side walls 38 of the drawer guide 16, securing and essentially locking the drawer guide plastic 18 to the drawer guide 16.

As further illustrated in FIG. 5, each leg 50 includes a downwardly projecting tab 51 that extends from a top surface of the leg 50. The downwardly projecting tabs 51 are designed to be used to release the lock formed between the drawer guide plastic 18 and the drawer guide 16, as referred to above, and also release the drawer guide 16 for easy removal from the case runner 12. Further, the legs 50 of the drawer guide plastic 18 may be used to bypass the locking action of the cams 78 to allow drawer removal. More specifically, the downwardly projecting tabs 51 of the legs 50 are adapted to be disposed into recesses 53 disposed on side walls 38 of the drawer guide 16 when the tabs 54 are inserted into the projections 45 of the windows 44 of the side walls 38. When the projecting tabs 51 are squeezed in, the tabs 54 are unlocked or released from the projections 45 of the windows 44 in the sidewalls 38 of the drawer guide 16. This enables the drawer guide plastic assembly to bypass the locking action of the cams 78, allowing drawer removal.

As illustrated in FIGS. 7 and 8A-8D, the case runner plastic 14 includes a front end 72, a rear end 74, and a central portion 76 disposed between the front end 72 and the rear end 74. The central portion 76 is adapted to be secured to a drawer frame, such as a front drawer cross support by an attachment mechanism, such as a screw or similar fastener. A pair of cam mechanisms 78 is disposed near the front end 72, such that each cam mechanism 78 is disposed on either side of the central portion 76. A roller bearing surface 80 is disposed near the rear end 74 of the case runner plastic 14. The rear end 74 of the case runner plastic 14 is disposed within and removably secured to the front end 20 of the case runner 12 to form the case runner plastic assembly 15. The pair of side walls 26 of the case runner 12 contact the rear end 74 of the case runner plastic 14 when the case runner plastic 14 is disposed within and secured to the case runner plastic 14.

Figure 8A:
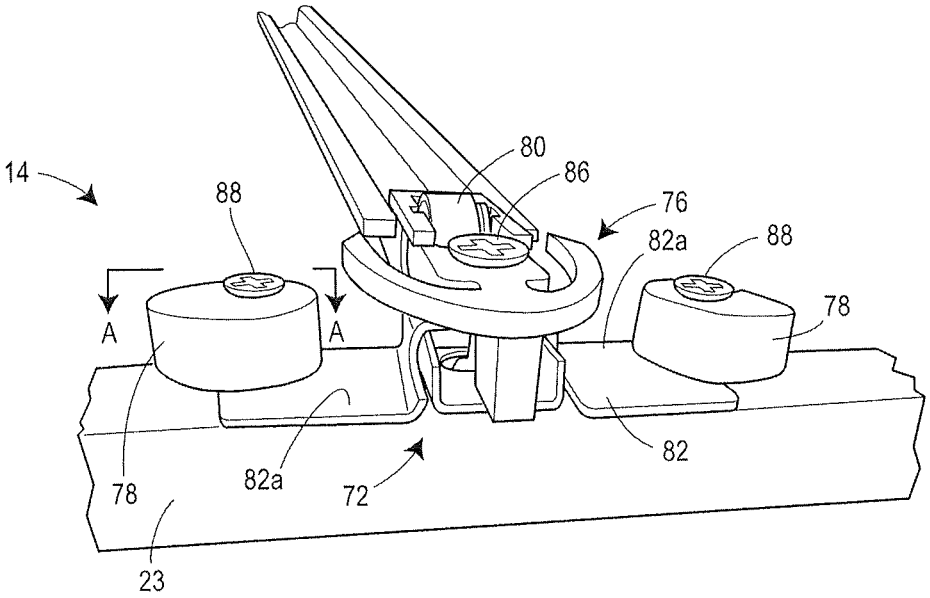
FIG. 8A a front perspective view of the case runner attached to the case runner plastic of FIG. 1.
Figure 8B:
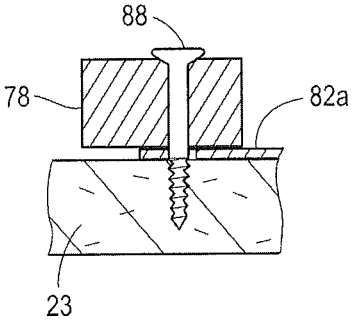
FIG. 8B is a partial cross-sectional view of a portion of the case runner plastic taken along the line A-A of FIG. 8A.
Figure 8C:
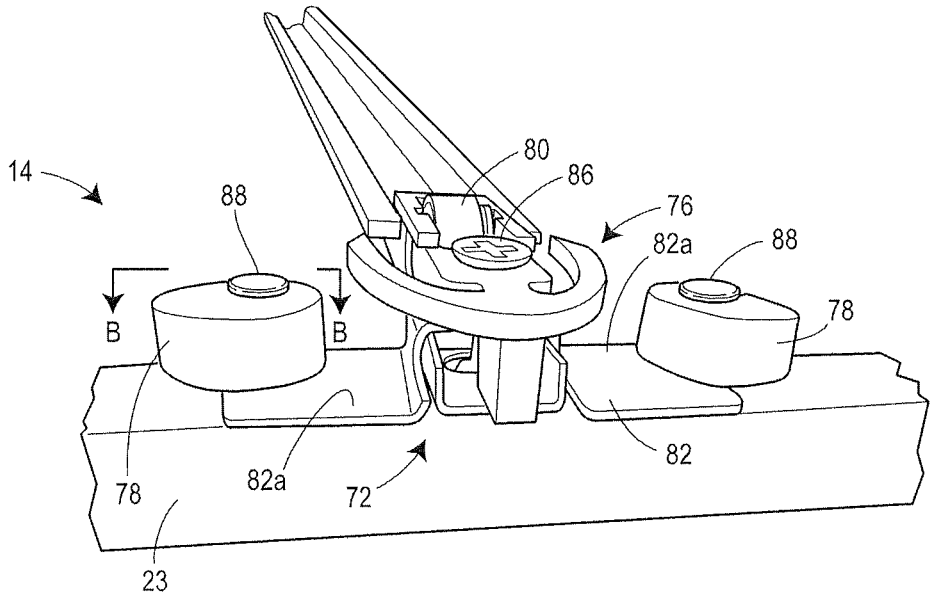
FIG. 8C is another front perspective view of the case runner attached to the case runner plastic of FIG. 1, illustrating another embodiment of an attachment mechanism of the case runner plastic.
Figure 8D:
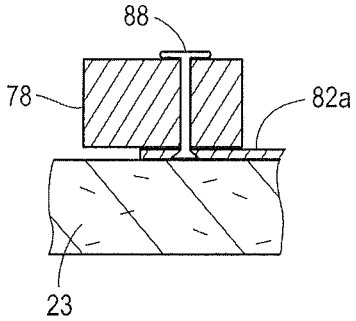
FIG. 8D is a partial cross-sectional view of a portion of the case runner plastic taken along the line B-B in FIG. 8C.

As illustrated in FIGS. 8A-8D, the case runner plastic 14 further includes a bracket 82 having an aperture (not shown) for receiving a fastener 86 or other attachment mechanism for securing the case runner plastic 14 to the drawer frame. The bracket 82 of the case runner plastic 14 further includes a pair of wings or feet 82*a* to which the cam mechanisms are rotatably secured. In other words, the central portion 76 of the case runner plastic 14 is secured to the drawer frame 23 via the fastener 86. The fastener 86 is disposed in the aperture of the bracket 82 and then the drawer frame 23. Each of the cam mechanisms 78 is rotatably secured to the bracket 82 via an attachment mechanism 88, such as a screw or rivet. In one embodiment, and as illustrated in FIGS. 8A and 8B, the cam mechanisms 78 are directly secured to the drawer frame 23 with the attachment mechanism 88 being in the form of a screw that passes not only through the aperture in the cam mechanism 78 and the feet 82*a* of the bracket 82 of the case runner plastic 14, but also into the drawer frame 23. Alternately, and as illustrated in FIGS. 8C-8D, having only the central portion 76 of the case runner plastic 14 secured to the drawer frame 23, and not the feet 82*a* of the bracket 82, results in an easier and more efficient process of assembling the case runner 12 to the drawer frame. This can be accomplished by rotatably securing the cam mechanisms 78 to the feet 82*a* by attachment mechanisms 88 in the form of rivets that do not extend into the drawer frame 23, as illustrated in FIG. 8D.

Figure 9:
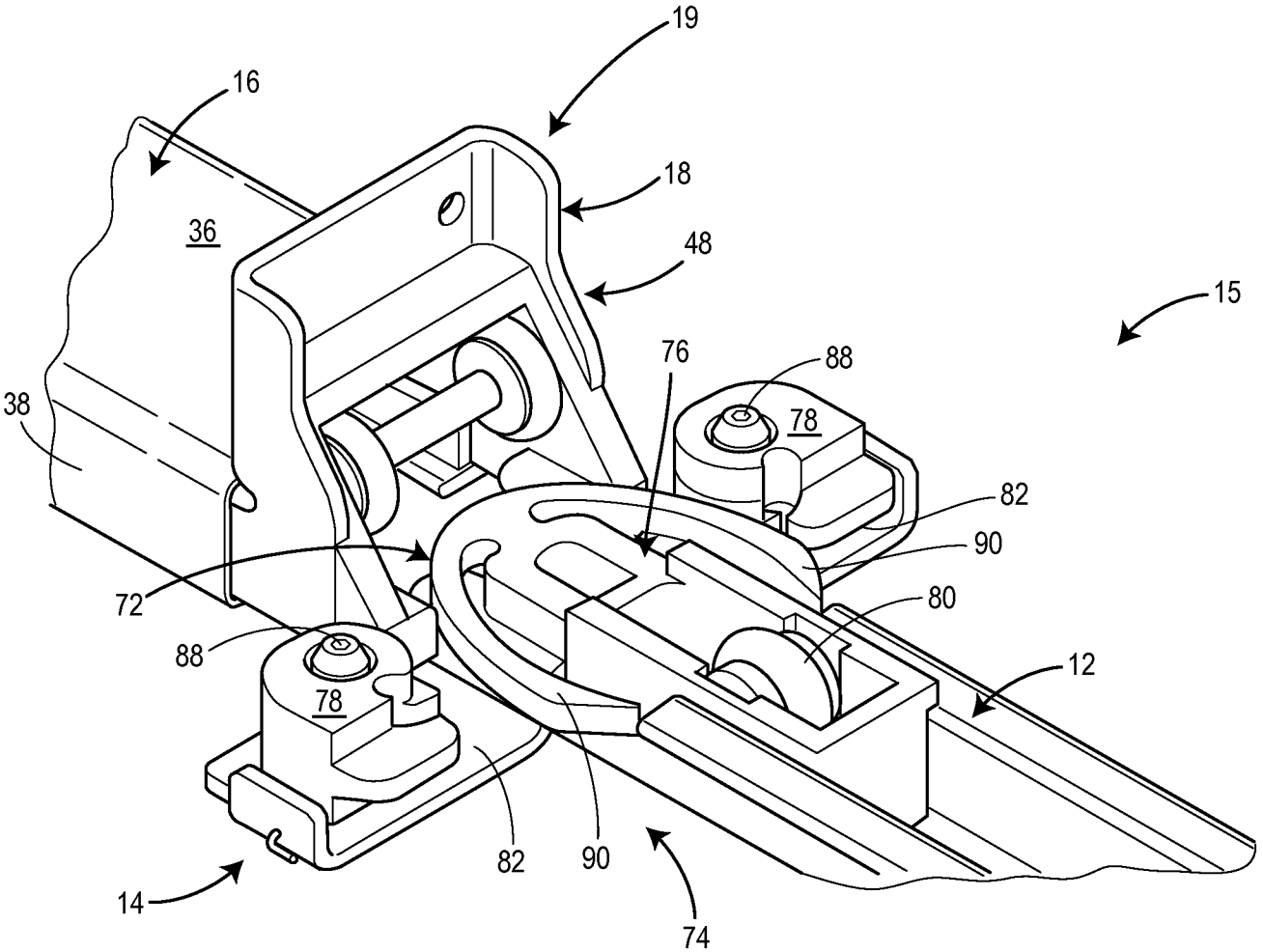
FIG. 9 is a rear perspective view of the drawer guide plastic assembly positioned to move onto the case runner plastic assembly.

Referring now to FIG. 9, the drawer guide assembly 19 is positioned to move onto the case runner assembly 15. As illustrated therein, the central portion 76 of the case runner plastic 14 further includes a pair of arms 90 extending in a direction toward the rear end 74 of the case runner plastic 14 of the case runner assembly 15.

The roller bearing surface 80 of the rear end 74 of the case runner plastic 14 will contact a bottom surface of the top portion 36 of the drawer guide 16 as the drawer guide plastic assembly 19 moves over the case runner plastic 14 of the case runner assembly 15. This reduces the friction during relative movement between the case runner 12 and drawer guide 16, improving relative movement between the drawer guide 16 and the case runner 12.

In operation, the front end 46 of the drawer guide plastic 18 is inserted into the rear end 34 of the drawer guide 16, as illustrated, for example, in FIG. 6. As explained above, tabs 54 on each leg 50 of the pair of legs of the drawer guide plastic 18 readily fit and push into the windows 44 disposed on the side walls 38 of the drawer guide 16 at the rear end 34 of the drawer guide 16 after insertion. The tabs 54 of the legs 50 also find the projections 45 of the windows 44 of the side walls 38 of the drawer guide 16, securing and essentially locking the drawer guide plastic 18 to the drawer guide 16.

Figure 10:
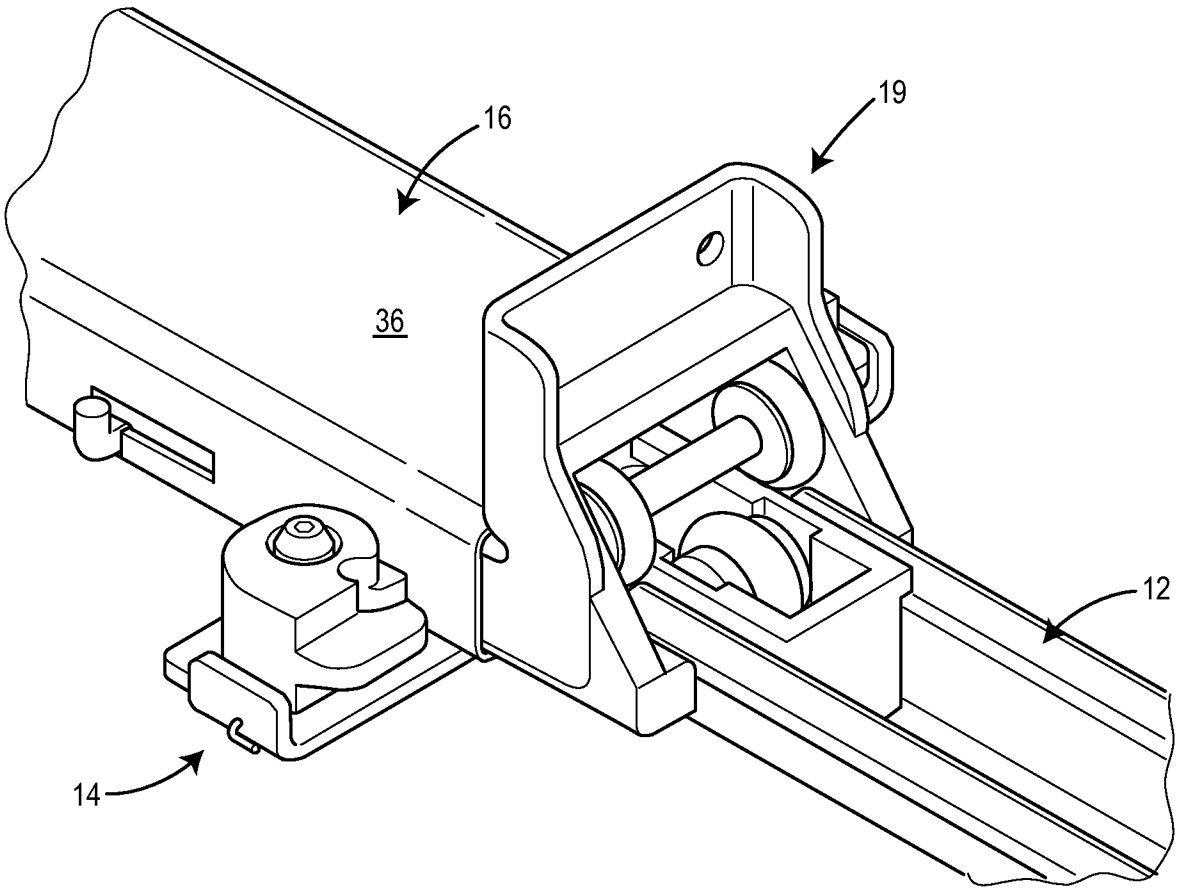
FIG. 10 is another rear perspective view of the drawer guide plastic assembly and case runner plastic assembly of the present disclosure.

After the drawer guide plastic 18 is secured to the drawer guide 16, forming the drawer guide plastic assembly 19, the rear end 48 of the drawer guide plastic 18 receives the front end 72 of the case runner plastic 14 of the case runner plastic assembly 15, as illustrated in FIG. 9. As noted, the case runner plastic 14 of the case runner plastic assembly 15 is secured to a portion of a drawer frame. The drawer guide plastic assembly 19 moves along a longitudinal axis of the case runner 12, as illustrated in FIG. 10, for example, to open and close the drawer of the drawer frame or cabinet. Thus, in a fully closed position (FIG. 14), the front end 32 of the drawer guide 16 is disposed at the front end of 72 of the case runner plastic 14 of the case runner plastic assembly 15. In a fully open or extended position, however, the rear end 34 of the drawer guide 16 is disposed near the front end 20 (FIG. 1) of the case runner 12 of the case runner plastic assembly 15, as partially illustrated in FIG. 13A, for example.

Figure 11:
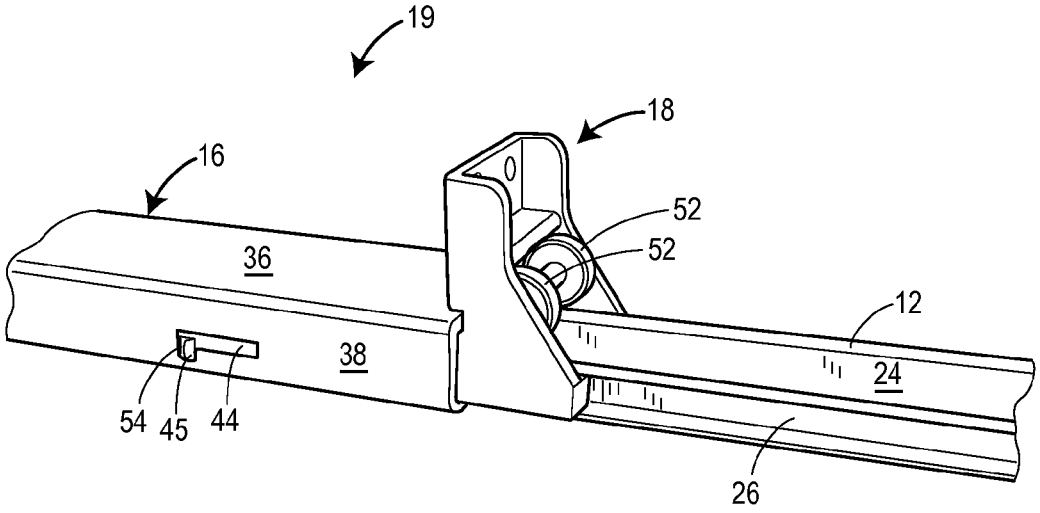
FIG. 11 is a side perspective view of the drawer guide plastic disposed within the drawer guide and having the case runner disposed therein.

Of course, there are various positions of the drawer guide 16 between the fully open position and the fully closed position, one of which is partially illustrated in FIG. 11. In this view, the drawer guide 16 and the drawer guide plastic 18 forming the drawer guide plastic assembly 19 are disposed between the rear end 22 and the front end 20 of the case runner 12 of the case runner plastic assembly 15 (FIG. 1). During such movement of the drawer guide plastic assembly 19 along the longitudinal axis of the case runner plastic, e.g., when the drawer guide plastic assembly 19 is moving from the fully closed position to the fully open position, the pair of rollers 52 contact the pair of flanges 28 of the case runner 12, reducing friction between the case runner 12 and the drawer guide 16 and improving overall movement between the same.

Figure 12A:
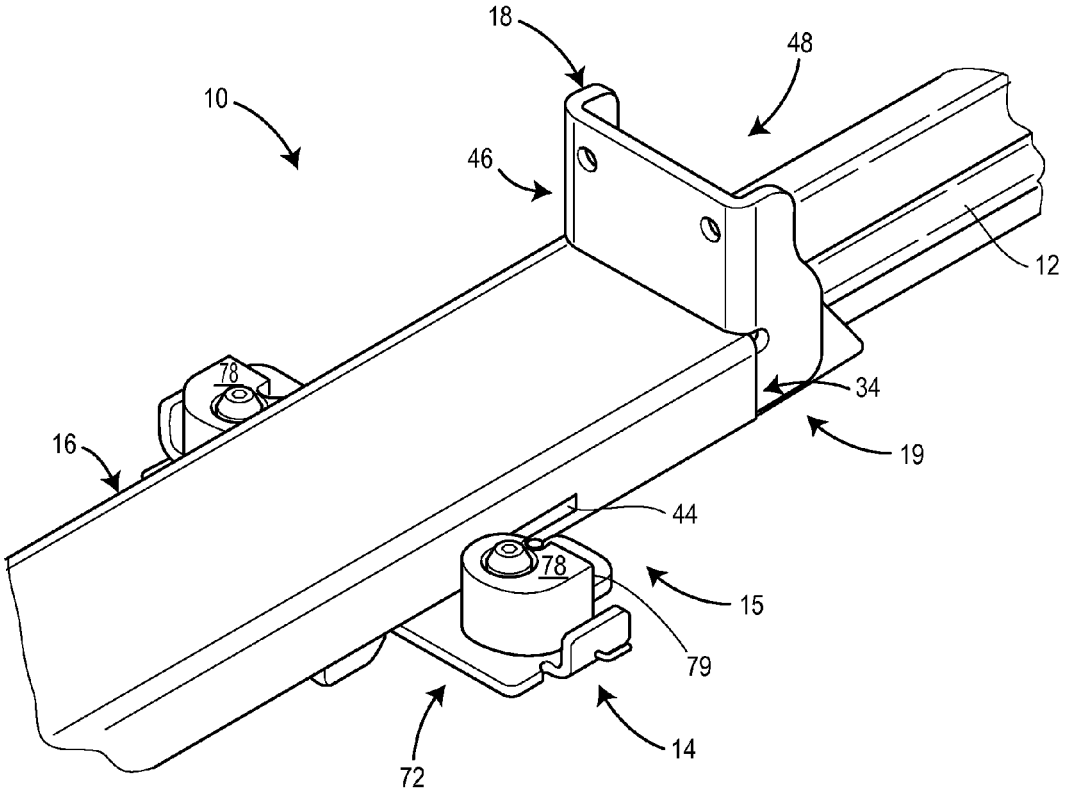
FIG. 12A is a front perspective view of a portion of the drawer guide system of the present disclosure, wherein the drawer guide plastic assembly is almost in a fully extended position.
Figure 12B:
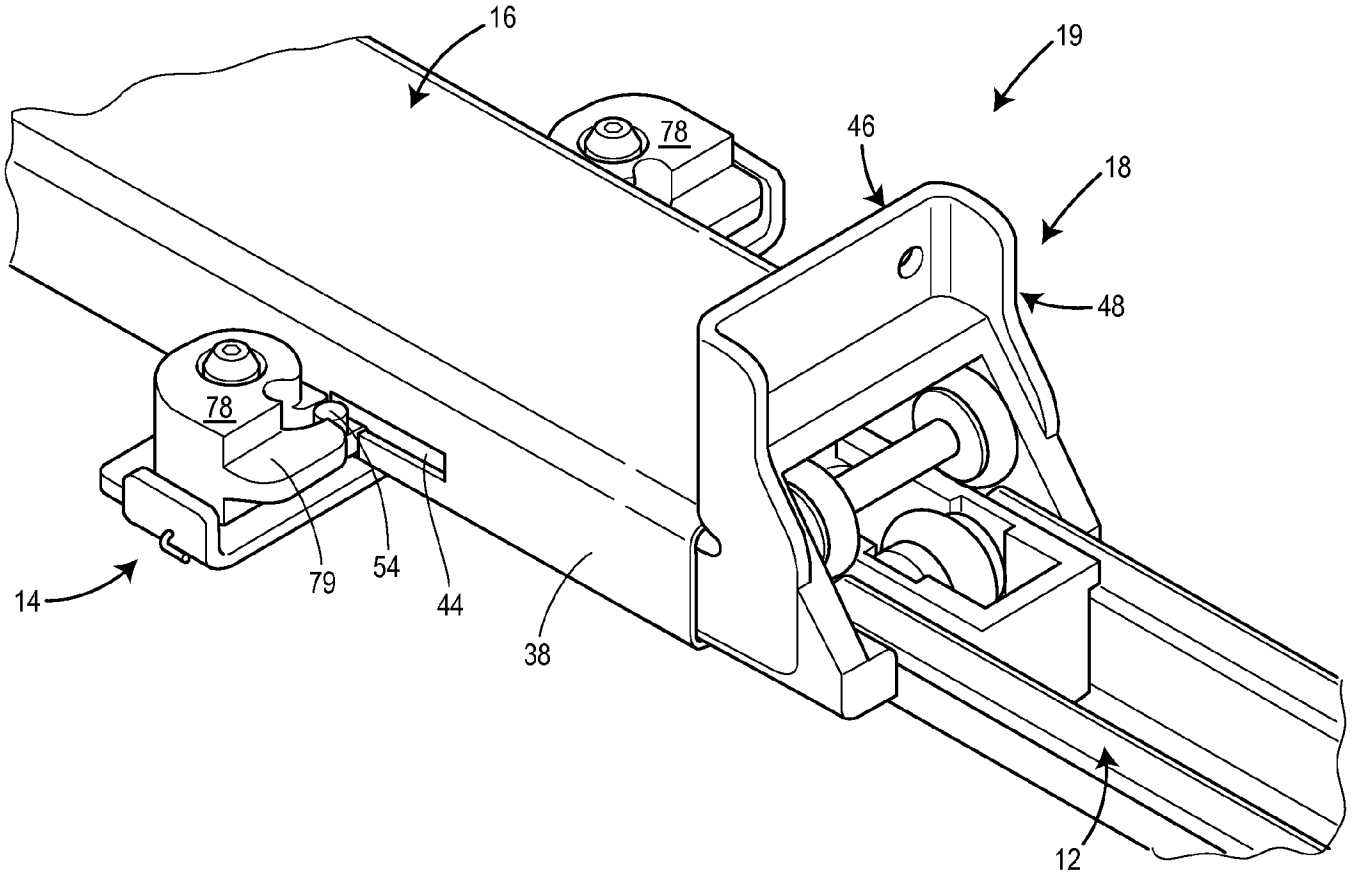
FIG. 12B is rear perspective view of the drawer guide system of FIG. 12B.

Referring now to FIG. 12A, a perspective, front partial view of a portion of the drawer guide system 10 of the present disclosure is illustrated, wherein the drawer guide plastic assembly 19 is almost in the fully extended position. As illustrated therein, when the rear end 34 of the drawer guide 16 of the drawer guide plastic assembly 19 approaches the front end 72 of the case runner plastic 14, the tabs 54 on the drawer guide plastic 18 disposed in the sidewall 44 of the drawer guide 16 contact the pair of cam mechanisms 78 of the case runner plastic assembly 15. This is further illustrated in FIG. 12B, which depicts a rear perspective view of FIG. 12A.

Figure 13A:
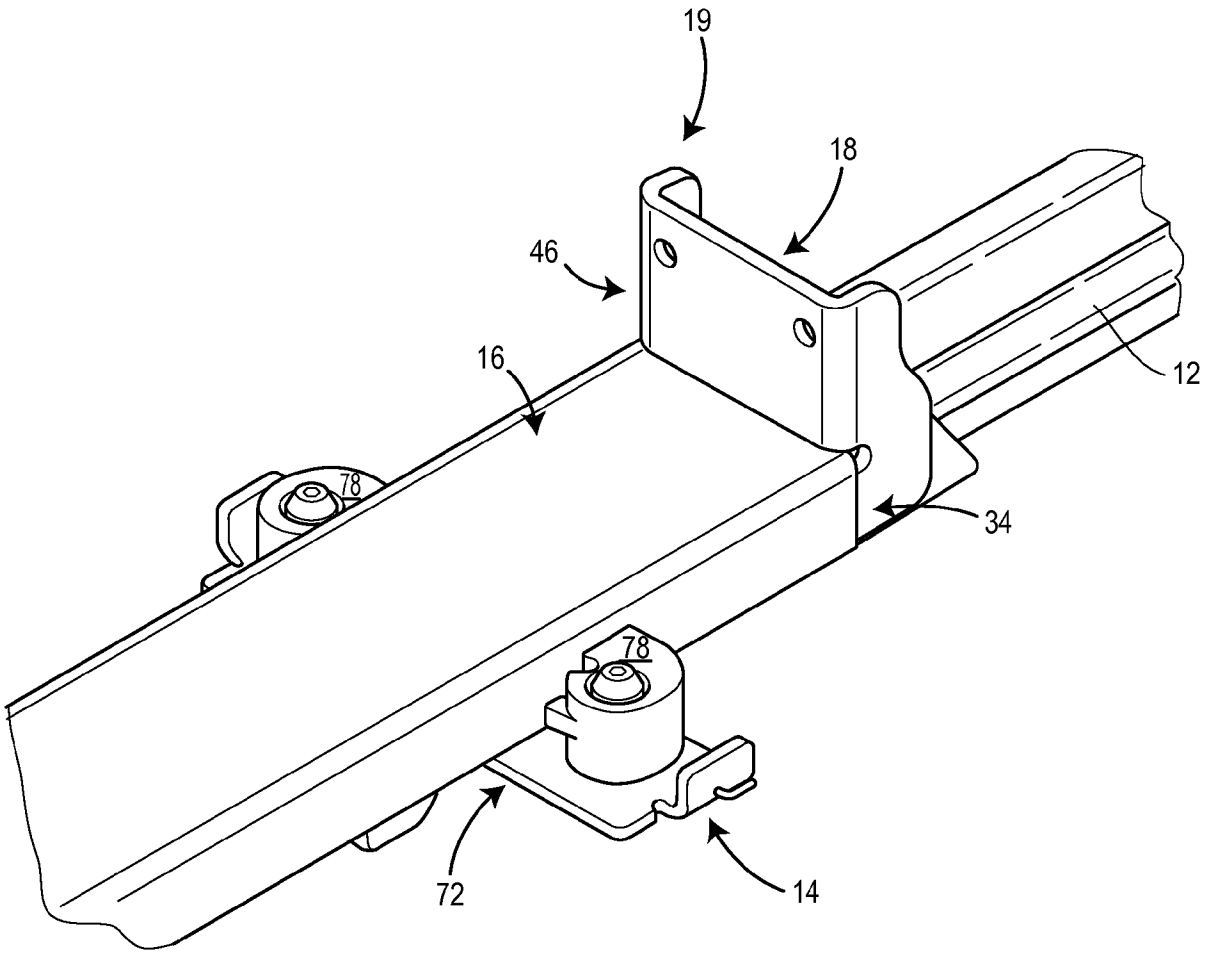
FIG. 13A is a front perspective view of the drawer guide system of the present disclosure, wherein the drawer guide plastic assembly is in a fully extended position.
Figure 13B:
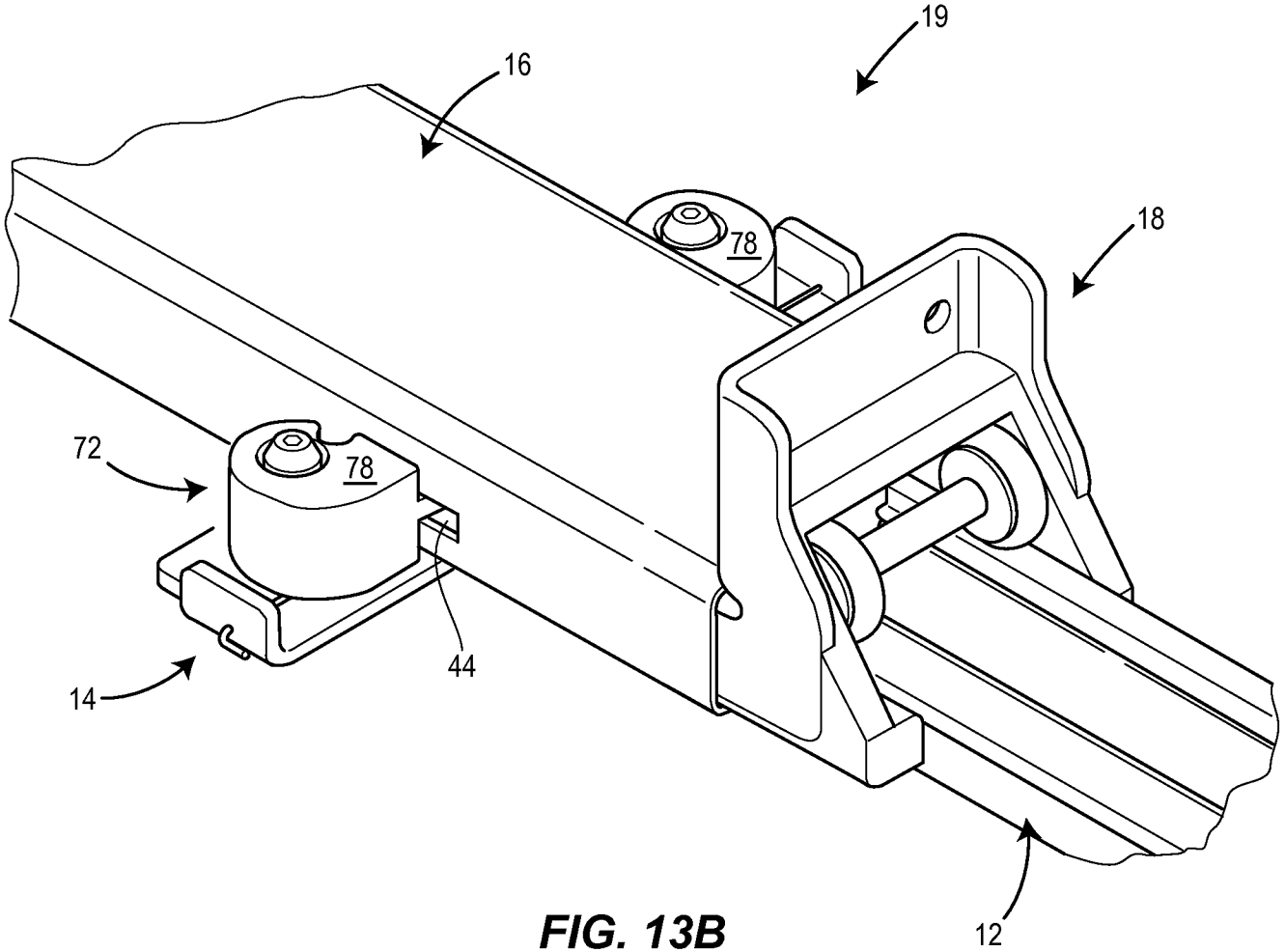
FIG. 13B is a rear perspective view of the drawer guide system of FIG. 13A.

Referring now to FIGS. 13A and 13B, after contacting the tabs 54 on the drawer guide plastic 18, the cam mechanisms 78 automatically rotate 90 degrees into the windows 44 of the drawer guide 16, essentially locking the drawer guide assembly 19 to the case runner assembly 15 and preventing the drawer guide assembly 19 from further movement. Thus, the drawer guide assembly 19 is in a fully extended position.

In other words, the cam mechanisms 78 simultaneously rotate from a first position upon initial contact with the tabs 54 of the drawer guide plastic 16 to a second position, in which the cam mechanisms 78 are inserted into the windows 44 of the drawer guide 16. More specifically, each cam mechanism 78 includes a finger 79 that contacts and engages the tab 54 disposed in the window 44 of the drawer guide 16. Such contact and engagement causes the cam mechanisms 78 to rotate 90 degrees into the windows 44, reaching the second position and temporarily securing the drawer guide 16 to the case runner plastic 14. Such engagement prevents further extension of the drawer guide plastic assembly 19 and maintains the balance of the cabinet or drawer frame in which the drawer and, thus, the drawer guide assembly 19, are disposed.

Said another way, upon contact with the tabs 54 of the drawer guide 16, the cam mechanisms 78 automatically rotate about an axis perpendicular to the longitudinal axis of the case runner 12. The cam mechanisms 78 rotate 90 degrees into each window 44 of the drawer guide, temporarily securing the case runner plastic 14 to the drawer guide 16 and preventing any further extension or movement of the drawer guide 16.

Engagement between the fingers 79 of the cam mechanisms 78 and the tabs 54 and rotation of the cam mechanisms 78 into the windows 44 creates an interference outside of the longitudinal axis of the case runner 14 to counterbalance the weight of the fully extended drawer. More specifically, the front end 32 of the drawer guide plastic 16, e.g., FIGS. 1 and 14, creates a bending moment upon extension of the drawer guide 16 along the longitudinal axis of the case runner 12 from the fully closed position (FIG. 14) to a position extended approximately two-thirds of the way outside of the drawer. Upon further movement of the drawer guide plastic assembly 19 along the longitudinal axis of the case runner 14 (FIGS. 13A and 13B), the cam mechanisms 78 contact the tabs 54 and then rotate in a direction perpendicular to the longitudinal direction of the case runner 14 to engage the windows of the drawer guide 16. Such engagement between the cam mechanisms 78 of the case runner plastic assembly 15 and the drawer guide 16 of the drawer guide plastic assembly 19 creates the interference or force in a direction different from the longitudinal axis of the case runner 12 along which the drawer guide plastic assembly 19 travels. The interference or force counterbalances the bending moment of the drawer guide 16, and ultimately the drawer, into which it is secured, preventing the drawer from becoming dislodged in, or tipping out of, the drawer frame.

Figure 14:
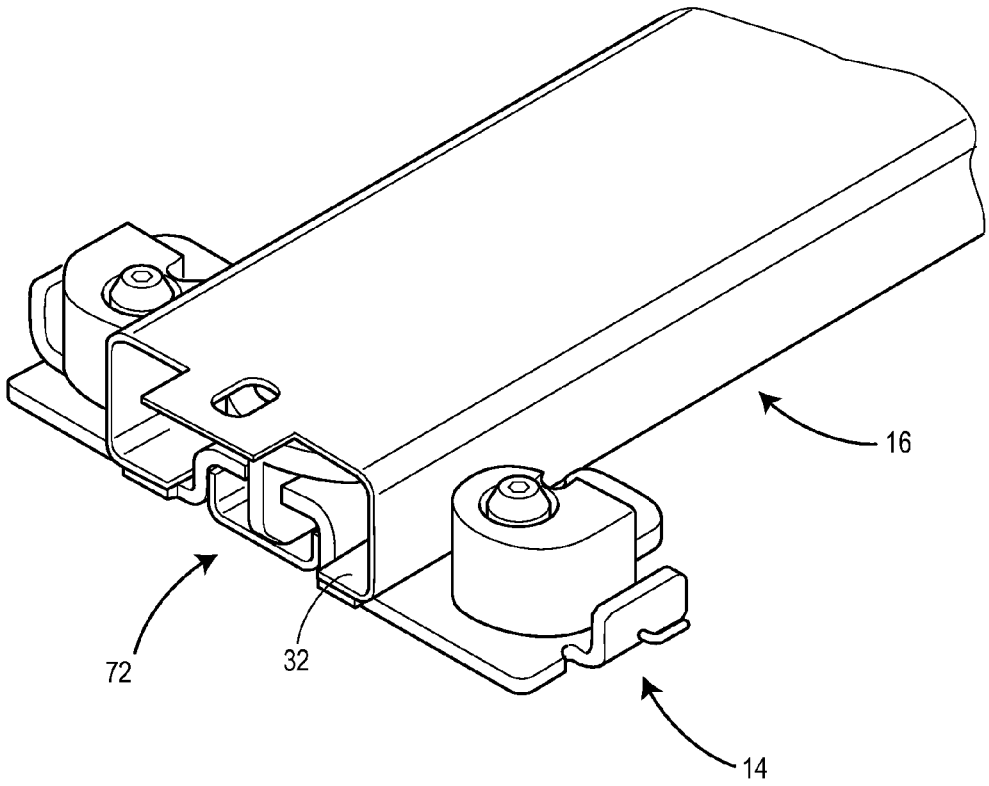
FIG. 14 is a front perspective view of a portion of the drawer guide system of the present disclosure when a drawer is in a fully closed position.

Referring now to FIG. 14, a portion of the aforementioned drawer guide system 10 of the present disclosure is depicted when a drawer 25 (not shown) is in a fully closed position.

When the drawer 25 (not shown) is fully closed, the front end 32 of the drawer guide 16 of the drawer guide plastic assembly 19 cannot move any farther than the front end 72 of the case runner plastic 14 to expose the case runner plastic 14, for example. In other words, the case runner plastic 14 of the case runner plastic assembly 15 is prevented from exiting the drawer guide 16 at this end.

While the preceding text sets forth a detailed description of numerous different embodiments of the invention, it should be understood that the legal scope of the invention is defined by the words of the claims set forth at the end of a patent claiming priority hereto. The detailed description is to be construed as exemplary only and does not describe every possible embodiment of the invention since describing every possible embodiment would be impractical, if not impossible. Numerous alternative embodiments could be implemented, using either current technology developed after the filing date of this patent, which would still fall within the scope of the claims of the patent. More generally, although certain example systems and assemblies have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A case runner plastic assembly for a drawer guide system comprising:

a case runner having a front end, a rear end, a base, a pair of side walls attached to the base and a pair of outwardly extending flanges attached to the pair of side walls and extending from the front end; and a case runner plastic having a front end, a rear end, a central portion adapted to be secured to a drawer frame, a pair of cam mechanisms, each cam mechanism disposed on either side of the central portion, and a roller bearing surface disposed in the rear end, wherein the rear end of the case runner plastic is disposed within and removably secured to the front end of the case runner such that the pair of side walls of the case runner contact the rear end of the case runner plastic and the pair of cam mechanisms is rotated upon contacting a tab of a drawer guide plastic and engages and locks a pair of side walls of a drawer guide when the drawer guide is in a fully extended position.

2. The case runner plastic assembly of claim 1, the case runner plastic further comprising a bracket having an aperture for receiving an attachment mechanism for securing the case runner plastic to the drawer frame, wherein the central portion and the pair of cam mechanisms are disposed on the bracket.

3. The case runner plastic assembly of claim 2, wherein each cam mechanism of the pair of cam mechanisms is secured to the bracket via the attachment mechanism.

4. The case runner plastic assembly of claim 1, wherein the central portion further comprises a pair of arms extending therefrom, the pair of arms adapted to be wedged between the pair of side walls of the drawer guide during movement of the drawer guide along the case runner plastic assembly.

5. A drawer guide plastic assembly for a drawer guide system comprising:

a drawer guide having a front end, a rear end, a top portion, a pair of side walls attached to the top portion, a pair of inwardly extending flanges attached to the pair of side walls and extending from the front end to the rear end, an elongate recess disposed between the top portion and the pair of side walls, and a window disposed at a rear end of each side wall of the pair of side walls; and a drawer guide plastic adapted to be partially disposed within the recess at the rear end of the drawer guide, the drawer guide plastic having a front end with a pair of legs extending therefrom and a rear end having a pair of rollers disposed therein, each leg of the pair of legs including a tab adapted to be disposed within each window of the pair of side walls upon insertion of the pair of legs of the drawer guide plastic into the rear end of the drawer guide, wherein the tabs of the drawer guide plastic extend outside of the windows of the pair of side walls and, upon contact with a pair of cam mechanisms of a case runner plastic, cause the cam mechanisms to rotate into the windows of the drawer guide, forming a stop mechanism and preventing further movement of the drawer guide, and the pair of rollers of the drawer guide plastic is adapted to contact a pair of flanges of a case runner, reducing friction between the drawer guide and the case runner.

6. The draw guide plastic assembly of claim 5, wherein the pair of legs extending from the front end of the drawer guide plastic is biased in an outward direction, allowing the projections to readily enter the slots within the side walls of the draw guide after the front end of the drawer guide plastic is inserted into the rear end of the drawer guide.

7. The drawer guide plastic assembly of claim 5, wherein the stop mechanism is formed when the drawer guide is in a fully extended position and wherein the fully extended position is a position in which the rear end of the drawer guide is disposed at a front end of a case runner.

8. The drawer guide plastic assembly of claim 5, wherein the drawer guide comprises at least a metal material.

9. The drawer guide plastic assembly of claim 5, the drawer guide plastic further comprising an upright portion disposed between the front end and the rear end of the drawer guide plastic, the upright portion having a front end, a rear end, and a notch disposed on the rear end that engages an edge of the rear end of the drawer guide upon insertion of the legs of the drawer guide plastic into the rear end of the drawer guide.

10. The drawer guide plastic assembly of claim 5, wherein each window of each of the side walls is disposed toward the rear end of the drawer guide.

11. The drawer guide plastic assembly of claim 5, wherein each window includes a projection for receiving each tab of the pair of legs of the drawer guide plastic.

12. A drawer guide system comprising:

a case runner plastic assembly comprising a case runner having a front end, a rear end, a base, a pair of side walls attached to the base and a pair of outwardly extending flanges attached to the pair of side walls and extending from the front end to the rear end; and a case runner plastic having a front end, a rear end, a central portion disposed between the front and rear ends and adapted to be secured to a drawer frame, a pair of cam mechanisms, each cam mechanism disposed on either side of the central portion, and a roller bearing surface disposed in the rear end, wherein the rear end of the case runner plastic is disposed within and removably secured to the front end of the case runner such that the pair of side walls of the case runner contact the rear end of the case runner plastic; and a drawer guide plastic assembly comprising a drawer guide having a front end, a rear end, a top portion, a pair of side walls attached to the top portion, a pair of inwardly extending flanges attached to the pair of side walls and extending from the front end to the rear end, an elongate recess disposed between the top portion and the pair of side walls, and a window disposed on each side wall of the pair of side walls; and a drawer guide plastic adapted to be partially disposed within the drawer guide, the drawer guide plastic having a front end, a rear end, a pair of rollers disposed in the front end, a pair of legs extending from the rear end and biased in a outward direction, each leg of the pair of legs having a tab adapted to be disposed within the window of the pair of side walls upon insertion of the pair of legs of the drawer guide plastic into the drawer guide, wherein the recess at the front end of the drawer guide receives the case runner plastic assembly, such that the pair of rollers of the drawer guide plastic run along top surfaces of the pair of flanges of the case runner, reducing friction between the case runner and the drawer guide; and wherein the cam mechanisms of the case runner plastic engage the windows of the side walls of the drawer guide when the drawer guide is in a fully extended position, forming a lock between the drawer guide and the case runner plastic and preventing any further extension of the drawer guide plastic assembly.

13. The drawer guide system of claim 12, wherein the fully extended position of the drawer guide plastic assembly is a position in which the rear end of the drawer guide is disposed at the front end of the case runner plastic.

14. The drawer guide system of claim 12, wherein the fully extended position of the drawer guide plastic assembly is a position in which the rear end of the drawer guide is disposed near the pair of cam mechanisms.

15. The drawer guide system of claim 12, wherein the each cam mechanism of the pair of cam mechanisms simultaneously rotates upon initial contact with the tabs of the drawer guide plastic until each cam mechanism engages the window disposed near the rear end of the drawer guide to stop movement of the drawer guide.

16. The drawer guide system of claim 12, wherein each cam mechanism of the pair of cam mechanisms includes a finger that engages the projection disposed in each window near the rear end of the drawer guide, causing rotation of the cam mechanism into the window of the drawer guide and temporarily securing the drawer guide to the case runner plastic to prevent further extension of the drawer guide.

17. The drawer guide system of claim 12, wherein each cam mechanism of the pair of cam mechanisms simultaneously rotates from a first position upon initial contact with a tab of the drawer guide plastic to a second position upon engagement with the window of the side wall of the drawer guide.

18. The drawer guide system of claim 17, wherein fingers of the cam mechanisms are inserted into the windows of the drawer guide in the second position, temporarily securing the drawer guide to the case runner plastic assembly and preventing movement of both the cam mechanisms and the drawer guide plastic assembly.

19. A drawer guide system comprising:

a case runner plastic assembly having a case runner plastic adapted to be secured to a drawer frame, and a case runner attached to the case runner plastic, the case runner plastic having a pair of cam mechanisms; and a drawer guide plastic assembly having a drawer guide adapted to be secured to a drawer, and a drawer guide plastic inserted into and secured to the drawer guide, the drawer guide plastic having a pair of tabs, wherein the drawer guide includes a pair of sidewalls, each sidewall having a window for receiving the pair of tabs of the drawer guide plastic, the drawer guide adapted to run along a longitudinal axis of the case runner during operation of the drawer;

wherein, upon contact with the tabs of the drawer guide plastic, the cam mechanisms automatically rotate about an axis perpendicular to the longitudinal axis of the case runner into the windows of the drawer guide, temporarily securing the case runner plastic to the drawer guide and preventing any further extension of the drawer guide.

20. A drawer guide system comprising:

a case runner plastic assembly having a case runner plastic adapted to be secured to a drawer frame, and a case runner attached to the case runner plastic, the case runner plastic having a pair of cam mechanisms; and a drawer guide plastic assembly having a drawer guide adapted to be secured to a drawer, and a drawer guide plastic inserted into and secured to the drawer guide, the drawer guide plastic having a pair of tabs, wherein the drawer guide includes a pair of side walls, each sidewall having a window for receiving the tabs of the drawer guide plastic, the drawer guide adapted to run along a longitudinal axis of the case runner during operation of the drawer;

wherein, upon contact with the tabs of the drawer guide plastic, the cam mechanisms automatically rotate into the windows of the drawer guide, creating an interference outside of the longitudinal axis of the case runner to counterbalance the weight of a fully extended drawer.

21. The drawer guide system of claim 20, wherein a front end of the drawer guide assembly creates a bending moment upon extension of the drawer guide from a fully closed position to a position extended approximately two-thirds of the way outside of the drawer, and, upon further movement of the drawer guide to a fully extended position, the cam mechanisms rotate in a direction perpendicular to the longitudinal axis of the case runner and engage the windows of the drawer guide, creating a force that counterbalances the bending moment of the drawer guide.

* * * * *